US011247763B2

(12) United States Patent
Takano et al.

(10) Patent No.: US 11,247,763 B2
(45) Date of Patent: Feb. 15, 2022

(54) MARINE PROPULSION DEVICE CONTROLLER FOR STARTING/STOPPING ENGINE, MARINE PROPULSION SYSTEM INCLUDING THE SAME, AND ENGINE STARTER OF MARINE PROPULSION DEVICE

(71) Applicant: YAMAHA HATSUDOKI KABUSHIKI KAISHA, Iwata (JP)

(72) Inventors: Naoju Takano, Shizuoka (JP); Kentaro Takeda, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 188 days.

(21) Appl. No.: 16/705,306

(22) Filed: Dec. 6, 2019

(65) Prior Publication Data

US 2020/0198747 A1 Jun. 25, 2020

(30) Foreign Application Priority Data

Dec. 21, 2018 (JP) ..... JP2018-239756

(51) Int. Cl.
*B63H 20/16* (2006.01)

(52) U.S. Cl.
CPC ..... *B63H 20/16* (2013.01)

(58) Field of Classification Search
CPC ..... B63H 20/16
See application file for complete search history.

(56) References Cited

U.S. PATENT DOCUMENTS 4,850,906 A * 7/1989 Kanno ..... F02B 61/045 440/2
8,229,609 B2 * 7/2012 Bamba ..... F02D 41/062 701/21
8,968,040 B2 * 3/2015 Ito ..... B63H 25/42 440/1
9,120,548 B2 * 9/2015 Nakayasu ..... B63H 21/21
2010/0248560 A1 * 9/2010 Ito ..... B63H 25/42 440/1
2010/0250036 A1 * 9/2010 Bamba ..... B63H 21/213 701/21
2010/0256844 A1 * 10/2010 Ito ..... B63J 99/00 701/21
2017/0349256 A1 * 12/2017 Nakamura ..... B63H 20/20
2020/0198747 A1 * 6/2020 Takano ..... B63H 20/16

FOREIGN PATENT DOCUMENTS

JP 2010-236474 A 10/2010

* cited by examiner

*Primary Examiner* — S. Joseph Morano
*Assistant Examiner* — Jovon E Hayes
(74) *Attorney, Agent, or Firm* — Keating and Bennett, LLP

(57) ABSTRACT

A marine propulsion device controller includes a main operator that starts engines of all propulsion devices collectively with a simple operation and increases the degree of freedom of layout on a panel on which the main operator is disposed. The main operator is provided in common for all of the propulsion devices. The main operator receives a first operation and a second operation consecutively after receiving the first operation. All remote control ECUs are activated in response to receiving the first operation. The main operator outputs a collective start command to simultaneously start all the engines of the propulsion devices in response to receiving the second operation. Each remote control ECU starts the corresponding engine based on the collective start command.

16 Claims, 4 Drawing Sheets

MARINE PROPULSION DEVICE CONTROLLER FOR STARTING/STOPPING ENGINE, MARINE PROPULSION SYSTEM INCLUDING THE SAME, AND ENGINE STARTER OF MARINE PROPULSION DEVICE

CROSS REFERENCE TO RELATED APPLICATIONS

This application claims the benefit of priority to Japanese Patent Application No. 2018-239756 filed on Dec. 21, 2018. The entire contents of this application are hereby incorporated herein by reference.

BACKGROUND OF THE INVENTION

1. Field of the Invention

The present invention relates to a marine propulsion device controller that controls a plurality of marine propulsion devices each including an engine, a marine propulsion system including the controller, and an engine starter of the marine propulsion device.

2. Description of the Related Art

A marine propulsion device such as an outboard motor equipped with an engine is attached to, for example, the rear of a hull. Further, a plurality of marine propulsion devices may be attached to the hull to achieve a desired propulsive force. Japanese Laid-open Patent Publication (Kokai) No. 2010-236474 discloses a marine propulsion device controller capable of simultaneously starting a plurality of marine propulsion device engines attached to a marine vessel.

On the operation panel of the marine vessel disclosed in Japanese Laid-open Patent Publication (Kokai) No. 2010-236474, a key switch for supplying power to three marine propulsion devices at once is provided. The key switch can be operated between an OFF position and an ON position. On the operation panel, in addition to three individual switches for starting/stopping engines of the three marine propulsion devices individually, one all-device switch is provided for starting/stopping the three marine propulsion device engines at once. When the user switches the key switch from the OFF position to the ON position, power is collectively supplied to all the marine propulsion devices. When the power is supplied to all the marine propulsion devices, the user turns on the all-device switch such that the engines of all the marine propulsion devices are started at once.

However, regarding the marine propulsion device controller disclosed in Japanese Laid-open Patent Publication (Kokai) No. 2010-236474, individual operation of two operating elements including a key switch and an all-device switch is required to collectively start all the engines of a plurality of marine propulsion devices. Therefore, there is room for improvement in order to reduce the complexity of the operation. There is also room for improvement from the perspective of the layout when disposing a display and other operation mechanisms on the operation panel on which the key switch and the all-device switch are disposed.

SUMMARY OF THE INVENTION

Preferred embodiments of the present invention provide marine propulsion device controllers each able to collectively start the engines of all propulsion devices with a simple operation as well as increasing the degree of freedom of layout on a panel on which a main operator is disposed.

According to a preferred embodiment of the present invention, a marine propulsion device controller starts/stops an engine provided in each of a plurality of propulsion devices. The marine propulsion device controller includes a main operator and a start controller. The main operator outputs a start command to collectively start all engines of the plurality of propulsion devices. The start controller, in response to receiving a first operation on the main operator, is activated and starts all the engines of the plurality of propulsion devices collectively in response to receiving the start command. The main operator is provided in common for the plurality of propulsion devices, and is able to receive the first operation and a second operation after the first operation has been received, and receive the second operation consecutively after the first operation, and output the start command in response to receiving the second operation.

According to the present preferred embodiment, the start controller is activated in response to receiving the first operation. Further, a collective start command is output in response to receiving the second operation. Then, in response to receiving the collective start command, the start controller collectively starts all the engines. Therefore, a vessel operator is able to start all the engines collectively with a simple operation of performing the second operation consecutively after performing the first operation on a single operator, without the complexity of operating two operating elements individually as in the prior art. Further, a switch that starts the engine individually is not necessarily provided near the main operator on the panel where the main operator is disposed. Therefore, this makes it possible to start the engines of all propulsion devices collectively with a simple operation and increases the degree of freedom of layout on a panel on which a main operator is disposed.

In a preferred embodiment of the present invention, the main operator is preferably disposed at a maneuvering console of a marine vessel on which the plurality of propulsion devices are mounted. According to the present preferred embodiment, an engine start operation is easily performed. Furthermore, at the maneuvering console, the main operator is disposed on a panel on which at least one of remote controllers, a joystick, and a display is disposed. Accordingly, convenience is improved for a vessel operator not only when performing the engine start operation but also performing other operations. Furthermore, an individual start switch that individually starts each engine of the plurality of propulsion devices may be disposed at a position different from a panel on which the main operator is disposed at the maneuvering console. Accordingly, this increases the degree of freedom of layout on a panel that is frequently used.

In a preferred embodiment of the present invention, the second operation is preferably received when the main operator is switched from a first position corresponding to the first operation to a second position, and the main operator returns to the first position when contact with the main operator by the vessel operator is released after receiving the second operation. Accordingly, it is easy to re-do the second operation.

In a preferred embodiment of the present invention, preferably, the main operator is rotatably operated between an initial position and the second position via the first position, and the first operation is received when the main operator is switched from the initial position to the first position, and the second operation is received when the main operator is switched from the first position to the second position. Accordingly, activation of the start controller and start of all the engines is performed collectively by the continuous rotating operation on the main operator. Thus, the operation is simplified.

In a preferred embodiment of the present invention, the main operator preferably continues outputting the start command for a predetermined period of time in response to receiving the second operation. Accordingly, an incomplete start of the engine is prevented.

In a preferred embodiment of the present invention, a plurality of the start controllers are preferably provided to correspond to the plurality of propulsion devices, the main operator outputs the start command to a representative start controller among all the start controllers corresponding to the plurality of propulsion devices, the representative start controller starts a corresponding engine in response to receiving the start command from the main operator, and transfers the start command to the other start controllers among all of the start controllers, and each of the other start controllers starts a corresponding engine in response to receiving the transferred start command. Accordingly, the number of wires is reduced because only one wire is required to send a start command from the main operator to the start controller.

In a preferred embodiment of the present invention, preferably, the marine propulsion device controller includes a first notifier that notifies the start of all the engines in response to outputting the start command. Accordingly, the user is notified of the start of all the engines.

In a preferred embodiment of the present invention, preferably, a second notifier is included which notifies that there is an engine that does not start although the main operator outputs the start command. Accordingly, the user is notified of the engine that does not start.

In a preferred embodiment of the present invention, preferably, a switch is provided separately from the main operator and forcibly stops all the engines. Accordingly, all the engines are able to be stopped in an emergency.

According to a preferred embodiment of the present invention, a marine propulsion system includes a plurality of propulsion devices each including an engine, and the marine propulsion device controller described above that controls the plurality of propulsion devices. Accordingly, this makes it possible to start the engines of all propulsion devices collectively with a simple operation and increases the degree of freedom of layout on a panel on which the main operator is disposed.

According to a preferred embodiment of the present invention, an engine starter of a marine propulsion device is provided. The engine starter is provided in common for a plurality of propulsion devices, and is able to receive a first operation and a second operation after the first operation has been received, and receive the second operation consecutively after receiving the first operation. The engine starter starts a start controller that starts an engine provided in each of the plurality of propulsion devices in response to receiving the first operation, and outputs a start command to start all the engines of the plurality of propulsion devices collectively to the start controller in response to receiving the second operation. Accordingly, this makes it possible to collectively start the engines of all propulsion devices with a simple operation and increases the degree of freedom of layout on a panel on which the main operator is disposed.

According to preferred embodiments of the present invention, it is possible to start the engines of all propulsion devices collectively with a simple operation and increase the degree of freedom of layout on a panel on which a main operator is disposed.

Further features of the present invention will become apparent from the following description of preferred embodiments (with reference to the attached drawings).

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

Figure 1:
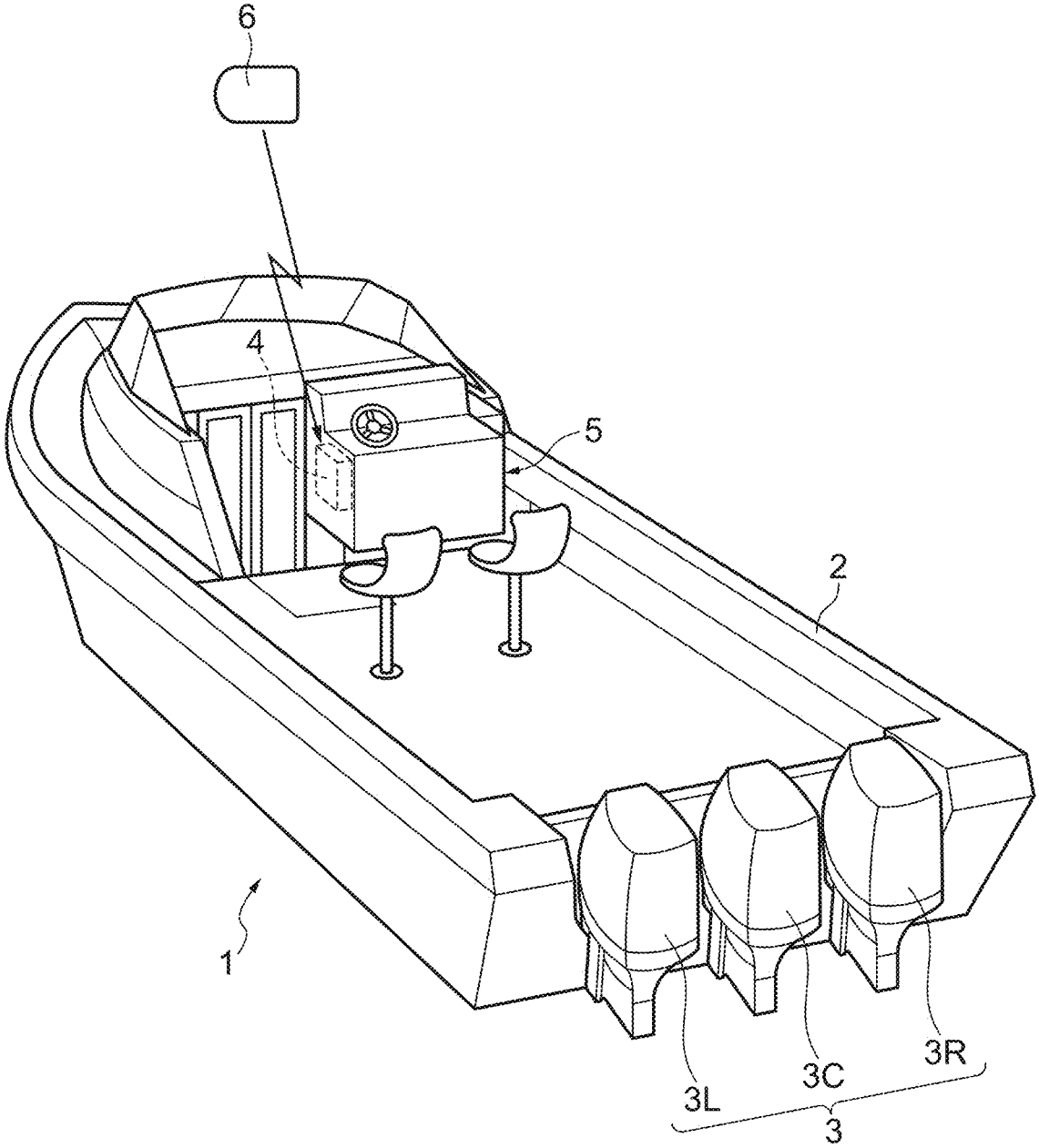
FIG. 1 is a diagrammatic perspective view of a marine vessel to which a marine propulsion device controller according to a preferred embodiment of the present invention is applied.

FIG. 1 is a diagrammatic perspective view of a marine vessel to which a marine propulsion device controller according to a preferred embodiment of the present invention is applied. A marine vessel 1 includes a hull 2 and a plurality of outboard motors 3 as marine propulsion devices mounted on the hull 2. The marine propulsion system according to a preferred embodiment of the present invention includes the marine propulsion device controller and the plurality of outboard motors 3. Three outboard motors 3 are attached to the stern of the hull 2 side by side, for example. To distinguish the three outboard motors 3, the one located on the port side is referred to as an "outboard motor 3L", the one located in the center is referred to as an "outboard motor 3C", and the one located on the starboard side is referred to as an "outboard motor 3R".

Detailed description will be provided below with reference to FIG. 4, but the outboard motors 3L, 3C, and 3R respectively include engines 61 (61L, 61C, and 61R) and outboard motor electronic controllers (ECUs) 20 (20L, 20C, and 20R), which are preferably internal combustion engines, for example. Further, the marine propulsion device controller of the present preferred embodiment includes remote control ECUs 60 (60L, 60C, and 60R) corresponding to the outboard motors 3L, 3C, and 3R. Each of the outboard motors 3L, 3C, and 3R obtains a propulsive force from a propeller (not illustrated) that is rotated by a driving force of the corresponding engines 61. A maneuvering console 5 is provided on the bow side which is the front portion of the hull 2. The maneuvering console 5 is provided with an immobilizer receiver 4 (FIG. 1). The immobilizer receiver 4 is a device that receives a signal from a transmitter 6 (FIG. 4), which is a key unit carried by the user of the marine vessel 1, and allows only the authorized user to use the marine vessel 1. Thereafter, L, C, and R characters are assigned to components provided corresponding to the outboard motors 3L, 3C, and 3R, respectively. L, C, and R characters are not assigned when the components are not distinguished for each outboard motor 3L, 3C, and 3R.

Figure 2:
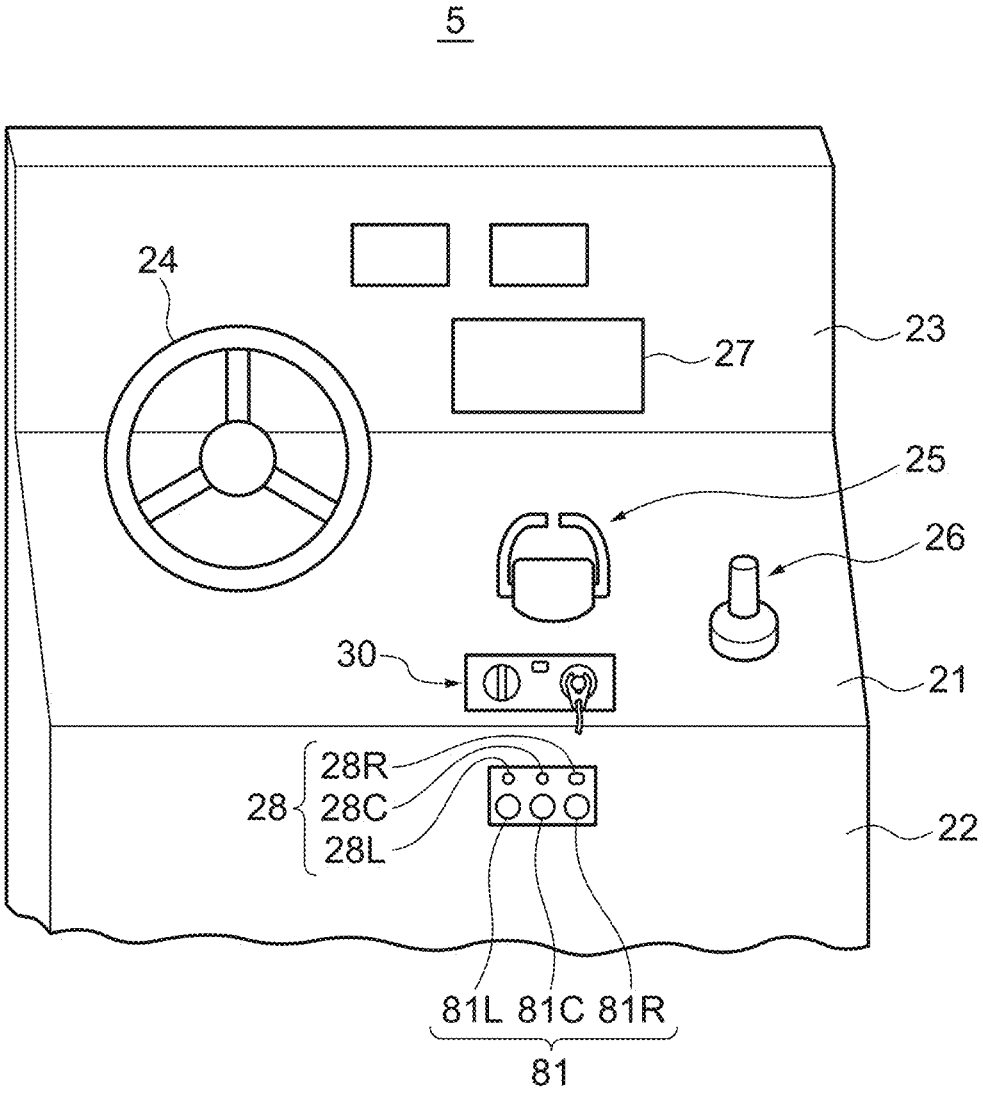
FIG. 2 is a diagrammatic perspective view of a main portion of a maneuvering console in the marine vessel of FIG. 1.

FIG. 2 is a diagrammatic perspective view of a main portion of the maneuvering console 5. The maneuvering console 5 includes a first surface 21, a second surface 22, and a third surface 23 that define panel surfaces. A steering device 24, a remote controller 25, a joystick 26, and a main operator 30 are disposed on the first surface 21 of the maneuvering console 5. Individual start switch buttons 81 (81L, 81C, and 81R) are provided on the second surface 22, which is different from the first surface 21 of the maneuvering console 5. A display panel 27 is disposed on the third surface 23, which is different from both the first surface 21 and the second surface 22 of the maneuvering console 5.

The steering device 24 allows a vessel operator to determine the course of the marine vessel 1. The vessel operator turns the marine vessel 1 right and left by rotating the steering device 24 right and left. By operating the remote controller 25, the vessel operator switches the direction of the propulsive force generated by the corresponding outboard motor 3 between the forward direction and the reverse direction, and is able to adjust the output of the corresponding outboard motor 3. The joystick 26 is tilted back and forth and right and left, and rotated around an axis. By operating the joystick 26, the vessel operator operates the marine vessel 1 with a course corresponding to the tilt direction of the joystick 26 and a propulsive force depending on the tilt amount of the joystick 26. In the normal mode, the outboard motor 3 is operated mainly by operating the steering device 24 and the remote controller 25. In the joystick mode, the outboard motor 3 is operated mainly by operating the joystick 26. The normal mode and the joystick mode are switched by, for example, a switch (not illustrated).

Various types of information are shown on the display panel 27. The display panel 27 is a color LCD display having a touch panel function, for example. For example, for each remote control ECU 60, a notification indicating that power has been supplied is shown on the display panel 27 corresponding to the remote control ECU 60. It should be noted that, in addition to the display panel 27, three LEDs that are lit corresponding to the remote control ECU 60 in which power is supplied may be provided.

The individual start switch buttons 81L, 81C, and 81R correspond to the outboard motors 3L, 3C, and 3R, respectively. The three individual lamps 28 (28L, 28C, and 28R) correspond to the individual start switch buttons 81L, 81C, and 81R. The individual start switch buttons 81 are momentary switches operated to individually start/stop the engines 61 of the corresponding outboard motors 3. When the individual start switch buttons 81 are operated when the engines 61 of the corresponding outboard motors 3 are stopped, individual start commands to start the engines 61 of the outboard motors 3 are generated. Further, when the individual start switch button 81 is operated while the engine 61 of the corresponding outboard motor 3 is in operation, a stop command to stop the engine 61 of the outboard motor 3 is generated. When the individual start switch button 81 is pressed for a long time during engine operation, that is, when the individual start switch button 81 is continuously pressed for a predetermined period of time or longer, a power-off command to cut off electric supply of the corresponding outboard motor 3 is generated. The individual lamps 28 are turned on when the corresponding engine 61 is started, and are turned off when the engine 61 is stopped.

Figure 3:
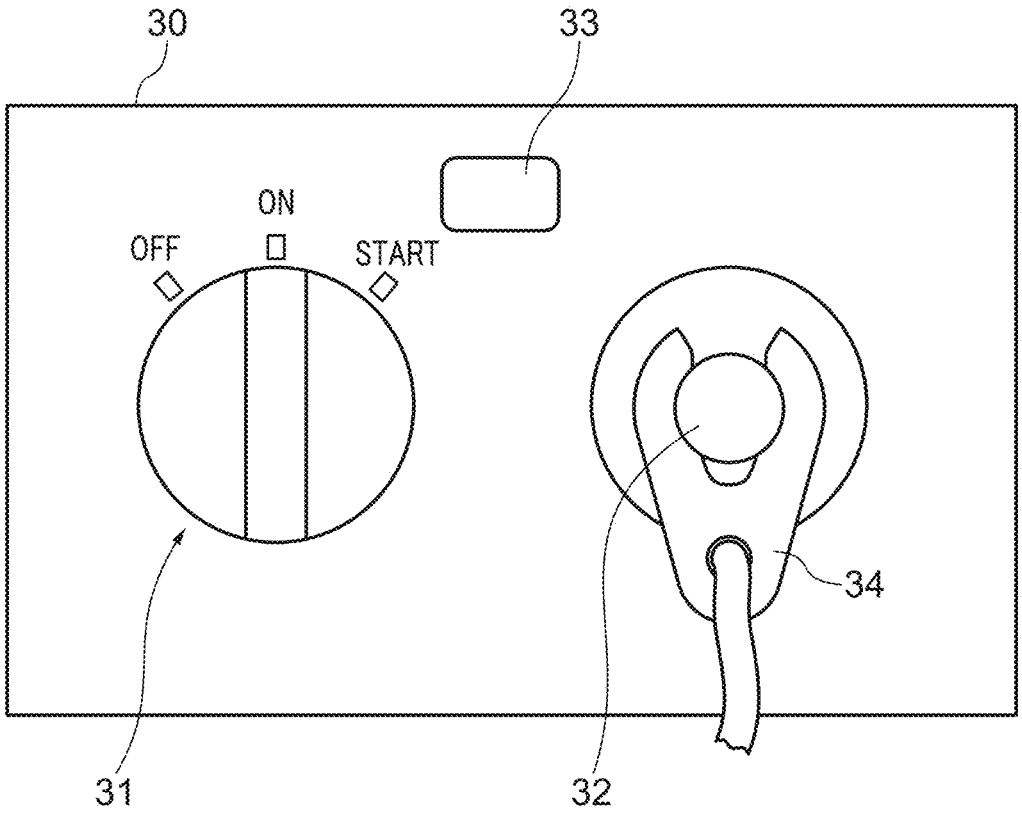
FIG. 3 is a view showing an example of a main operator at the maneuvering console of FIG. 2.

FIG. 3 is a view showing an example of the main operator 30. The main operator 30 includes an emergency switch 32 and a start lamp 33 in addition to a main switch 31. One main switch 31 is provided in common for the three remote control ECUs 60. The main switch 31 starts and stops all the remote control ECUs 60 and all the outboard motor ECUs 20 collectively, that is, supplies and shuts off power collectively. The main switch 31 also collectively starts and stops the engines 61 of the outboard motors 3 to which power is supplied. The start lamp 33 includes, for example, an LED. The start lamp 33 is turned on only when all three engines 61 are started, and is turned off when there is at least one engine 61 that does not start. Accordingly, the start lamp 33 corresponds to a first notifier that notifies the start of all the engines 61. It should be noted that the notification method is not limited to a lamp but may be a message display, or a sound generator, for example.

When a vessel operator inserts a key into a key cylinder (not illustrated), the main switch 31 is able to be switched among an Off position (OFF), an On position (ON), and a start position by a rotating operation. The OFF position cuts off power supplied to all remote control ECUs 60 and all outboard motors 3 at once. The ON position supplies power to all elements related to the outboard motor 3 including all the remote control ECUs 60 and all the outboard motor ECUs 20. The start position starts all the engines 61 to which power is supplied collectively.

The main switch 31 is rotatable between the OFF position (initial position) and the start position (second position) via the ON position (first position). The main switch 31 receives a "first operation" and a "second operation" after which the first operation is received. Specifically, the operation in which the main switch 31 is switched from the OFF position (initial position) to the ON position (first position) is the first operation. An operation in which the main switch 31 is switched from the ON position to the start position (second position) is a second operation. Therefore, the vessel operator is able to perform the second operation consecutively from the first operation by rotating the main switch 31 from the OFF position to the start position. The main switch 31 is included in the main operator (or engine starter) that activates all remote control ECUs 60 and the like in response to receiving the first operation, and outputs a collective start command to start all engines 61 in response to receiving the second operation. In other words, the first operation is a collective activating operation of all the remote control ECUs 60 and all the outboard motors ECU 20. The second operation is a collective start operation of the engine 61.

Then, the main switch 31 is urged in the rotational direction of the ON position by an urging member such as a spring (not illustrated) at least in the starting position. Accordingly, when the main switch 31 is located closer to the start position than the ON position, the main switch 31 automatically returns to the ON position when the vessel operator releases the main switch 31. For example, after receiving the second operation, the main switch 31 returns to the ON position when contact with the main switch 31 by the vessel operator is released. Incidentally, the output of the collective start command is continued for a predetermined period of time in response to the main switch 31 being moved to the start position and the second operation being received. Therefore, even when the vessel operator releases the main switch 31 immediately after moving the main switch 31 to the starting position, a cranking motion continues for a predetermined period of time. As a result, incomplete engine start is prevented. Further, the automatic return of the main switch 31 from the start position to the ON position enables the vessel operator to easily re-do the engine start operation even when the engine 61 does not start.

The emergency switch 32 forcibly stops the driving of the outboard motor 3. The emergency switch 32 is urged in a retracted direction. The emergency switch 32 is maintained in a protruding state by inserting a plate 34 under it. A wire is connected to the plate 34, and one end of the wire may be attached to the vessel operator. When the emergency switch 32 is retracted, the power supplied to all the remote control ECUs 60 and all the outboard motors 3 is cut off. For example, when the plate 34 is pulled out when the vessel operator has, for example, fallen from the marine vessel, the emergency switch 32 is retracted and the driving of the outboard motor 3 is forcibly stopped.

Figure 4:
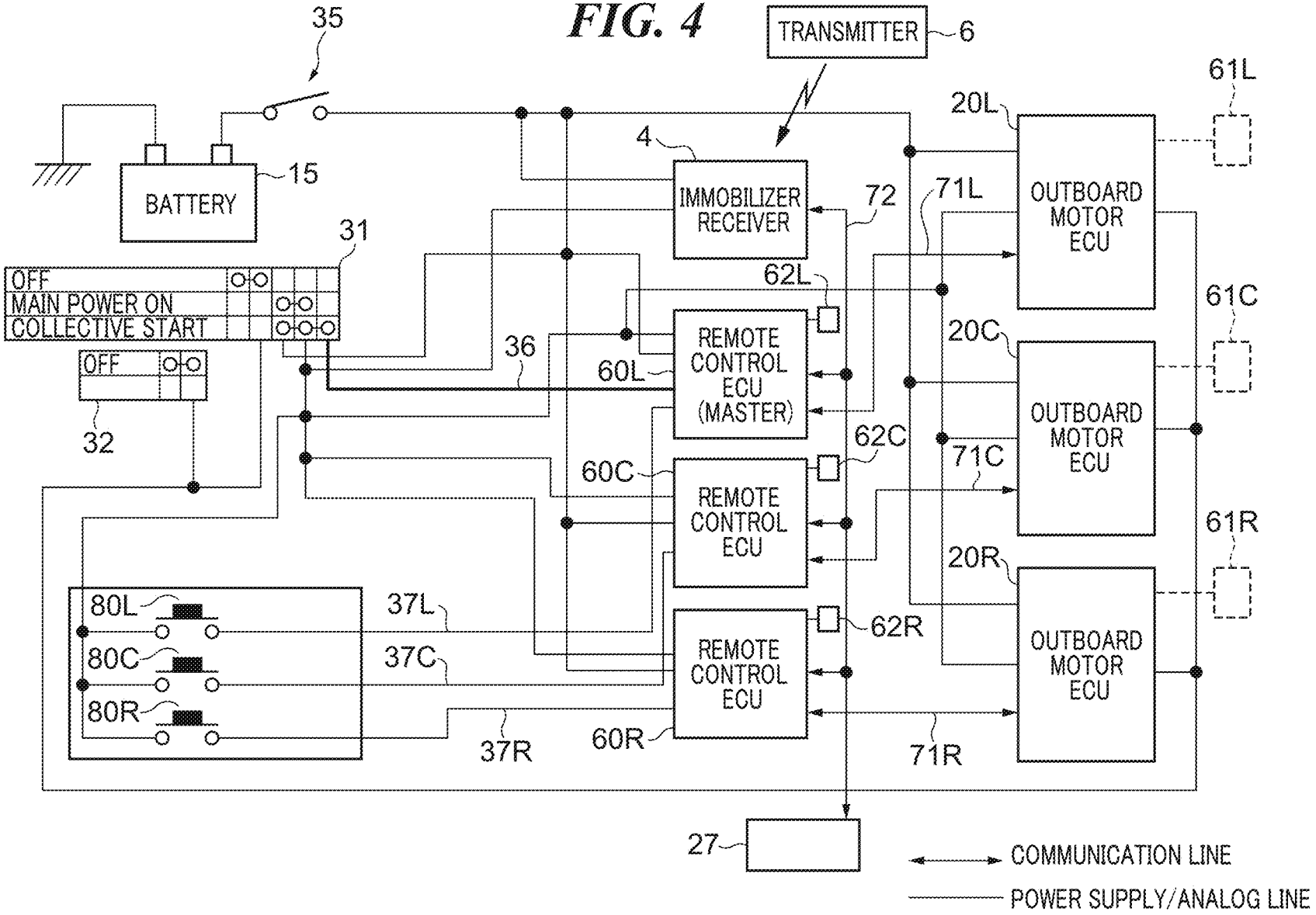
FIG. 4 is a diagram showing an electrical configuration of the marine vessel of FIG. 1.

FIG. 4 is a diagram showing an electrical configuration of the marine vessel 1. FIG. 4 shows a connection mode using a communication line, a power supply line, and an analog signal line. Each of the remote control ECUs 60L, 60C, and 60R exchanges various types of necessary information including command signals and detection signals with the corresponding outboard motor ECUs 20L, 20C, and 20R via the communication lines 71 (71L, 71C, and 71R). The remote control ECUs 60L, 60C, and 60R also exchange information with each other via the communication line 72. Further, the immobilizer receiver 4 and the display panel 27 are also connected to the remote control ECUs 60L, 60C, and 60R via the communication line 72. For communication on the communication line 71 and the communication line 72, for example, a control area network (CAN) protocol is used. It should be noted that the communication lines 71L, 71C, 71R, and 72 may be a local area network (LAN), for example, built in the marine vessel 1.

Of the three remote control ECUs 60, the remote control ECU 60L is a representative master remote control ECU that is a main remote control, and the remote control ECUs 60C and 60R are slave remote control ECUs. It should be noted that any one of the three remote control ECUs 60 may be the master. Signals output by operating the remote controller 25 and the joystick 26 are transmitted to the remote control ECU 60L that is the master remote control ECU. The remote control ECU 60L performs integrated control of each unit including the outboard motor ECU 20 based on the transmitted signal. It should be noted that the signal output from the steering device 24 is transmitted to a steering ECU (not illustrated), and steering based on the operation of the steering device 24 is controlled by the steering ECU. It should also be noted that, in addition to the three remote control ECUs 60, a central controller may be provided which communicates with the outboard motor 3, the steering device 24, the remote control ECU 60, and the remote controller 25 and integrally controls them.

The operating position of the remote controller 25 is detected by a potentiometer or the like. Information on the detected operating position is transmitted as an output signal from the remote controller 25 to the remote control ECU 60. The remote control ECU 60 sets the target shift position and the target engine rotation speed based on the operating position information, and transmits that information to the corresponding outboard motor ECU 20 via the communication line 71. Each of the outboard motor ECUs 20 performs cranking to rotate the crankshaft of the corresponding engine 61 by energizing a starter motor (not illustrated) during engine start control.

Each engine 61 is provided with a rotation detector that detects the rotation speed (or the number of rotations) by detecting the rotation of the crankshaft. The outboard motor ECU 20 acquires the engine rotation speed of the corresponding engine 61 from the rotation detector. The outboard motor ECU 20 sends the engine rotation speed data to the corresponding remote control ECU 60. The remote control ECU 60 is able to determine whether or not the corresponding engine 61 is in operation based on the engine rotation speed acquired from the outboard motor ECU 20. It should be noted that the remote control ECU 60 determines that the engine 61 has started when the engine rotation speed (or the number of rotations) of the engine 61 exceeds a predetermined value.

The remote control ECU 60, the outboard motor ECU 20, the immobilizer receiver 4 and the like are supplied with power from the battery 15 as a power source. The battery switch 35 is a switch that prevents current leakage when the marine vessel is stored.

As described with reference to FIG. 3, when the main switch 31 is in the OFF position, the power supplied to the remote control ECU 60 and all the outboard motors 3 is cut off. Further, when the emergency switch 32 is retracted, the power supplied to all the remote control ECUs 60 and all the outboard motors 3 is cut off, and all the engines 61 are stopped at the same time. The circular shapes in the main switch 31 and the emergency switch 32 of FIG. 4 indicate terminals, and one of a pair of the terminals is grounded. When the main switch 31 is in the OFF position, or the emergency switch 32 is in the retracted position, the power supplied to all the remote control ECUs 60 and all the outboard motors 3 is cut off when a pair of the terminals are connected each other.

When the main switch 31 is switched from the OFF position to the ON position, the power supply circuits incorporated in the remote control ECU 60 and the outboard motor ECU 20 are activated, and the computer incorporated therein starts operation. As a result, the remote control ECU 60 and the outboard motor ECU 20 are activated and enter a standby state. On the other hand, when the main switch 31 is switched from the ON position to the OFF position, the remote control ECU 60 and the outboard motor ECU 20 execute a predetermined termination process, and then cut off the power supplied to the power circuit and stop operating. In this way, it is possible to collectively supply and cut off electric power related to all the outboard motors 3.

When the main switch 31 is switched to the starting position, a collective start command to start all the engines collectively is transmitted to the master remote control ECU 60L through the signal line 36. The collective start command is not transmitted to the remote control ECUs 60C and 60R. This eliminates the need to provide wiring to transmit a collective start command from the main switch 31 to the slave remote control ECUs 60C and 60R, thus reducing the number of wirings. When receiving the collective start command, the remote control ECU 60L transfers the collective start command to the remote control ECUs 60C and 60R via the communication line 72. Each remote control ECU 60 defines and functions as a start controller that starts the corresponding engine 61 based on the received collective start command when the start permission condition is satisfied. The start permission condition, for example, includes not only that electric power is supplied but also that the engine is stopped and that the operating position of the remote controller 25 is in a neutral position. When all these conditions are satisfied, it is determined that the start permission condition satisfies the criteria.

It should be noted that the remote control ECU 60L transfers the collective start command to the remote control ECU 60C after a predetermined period of time has elapsed after receiving the collective start command. Then the collective start command is transferred to the remote control ECU 60R after the predetermined period of time has elapsed. This is because the start of each engine 61 is executed sequentially with a time interval. Accordingly, all the engines 61 are started collectively in the order of the remote control ECUs 60L→60C→60R. The predetermined period of time is assumed to be longer than the normal cranking time to start the engine.

It should be noted that the collective start command is transferred from the remote control ECU 60L to both of the other remote control ECUs 60C and 60R. However, the slave remote control ECU 60L may transfer the collective start command only to the remote control ECU 60 that is one order lower in engine start order than the slave remote control ECU 60L. For example, in the present preferred embodiment, the remote control ECU 60L may transfer the collective start command only to the remote control ECU 60C, and the remote control ECU 60C may transfer the received collective start command to the remote control ECU 60R.

The remote control ECU 60L may immediately transfer the collective start command without waiting for the elapse of a predetermined period of time. With this configuration, the engines 61 may be started simultaneously (substantially simultaneously). Alternatively, the collective start command may be transmitted from the main switch 31 to each of the remote control ECUs 60L, 60C, 60R all at once.

As described with reference to FIG. 3, when the individual start switch button 81 is operated, an individual start command, to start the engine 61 of the outboard motor 3, or a stop command is output as an output signal. Output signals from the individual start switch buttons 81L, 81C, and 81R are transmitted to the remote control ECUs 60L, 60C, and 60R through signal lines 37L, 37C, and 37R, respectively. When each remote control ECU 60 receives an output signal from the individual start switch button 81 while the corresponding engine 61 is stopped, the remote control ECU 60 interprets the signal as an individual start command. When each remote control ECU 60 receives an output signal from the individual start switch button 81 while the corresponding engine 61 is in operation, the signal is interpreted as a stop command. Each remote control ECU 60 starts the corresponding engine 61 based on the received individual start command. Further, each remote control ECU 60 stops the corresponding engine 61 based on the received stop command. Thus, the engine 61 is started/stopped individually.

Sound generators 62 (62L, 62C, and 62R) such as buzzers are connected to the remote control ECUs 60L, 60C, and 60R, respectively. Each remote control ECU 60 causes the corresponding sound generator 62 to generate a sound when there is an engine 61 that does not start even when a start command is output by operating the main switch 31 or the individual start switch button 81. The sound generator 62 corresponds to a second notifier that notifies the vessel operator when there is an engine 61 that does not start even when the start command is output.

It should be noted that the method of notifying that there is the engine 61 that does not start is not limited to sound, and a visual display may be used. It should be noted that the tone colors of the sound generators 62L, 62C, and 62R may be different from each other. As a result, the engine 61 that does not start is able to be recognized by listening to the tone, which is different from the others. It should be noted that the sound generator 62 is not necessarily provided for each engine, and only one sound generator 62 that generates sound may be provided even when there is at least one engine 61 that does not start.

According to the present preferred embodiment, in the main operator 30 provided in common for a plurality of outboard motors 3, the remote control ECUs 60L, 60C, and 60R are activated in response to receiving the first operation in which the main switch 31 is switched from the OFF position to the ON position. Further, a collective start command is output to the remote control ECU 60L in response to receiving the second operation in which the main switch 31 is switched from the ON position to the start position. Then, the remote control ECU 60L transfers the collective start command to the remote control ECUs 60C and 60R. In response to receiving the collective start command, each remote control ECU 60 starts the corresponding engine 61.

As described above, the vessel operator is able to start all the engines 61 collectively by a simple operation of switching the single main switch 31 from the OFF position to the start position through the ON position. This eliminates the complexity of operating two operating elements individually as in the prior art. Namely, the operation is simple and easy due to the continuous rotating operation of the main switch 31, without releasing the hand, and makes it possible to collectively start the remote control ECU 60, the outboard motor ECU 20, and all the engines 61. Further, since the main switch 31 is disposed on the first surface 21 of the maneuvering console 5, it is easy to perform collective activation of the remote control ECUs 60 and collective start operation of the engines.

Further, since the main switch 31 is a single element, it is not necessary to provide a separate switch to start all the engines other than the switch that turns on the power as in the prior art. For this reason, the degree of freedom in layout is increased when a display and other operation mechanisms are disposed on the first surface 21 which is the panel surface on which the main switch 31 is disposed. In particular, since the first surface 21 corresponds to a so-called "prime location" that is most easily operated and visually recognized, it is significant that the individual start switch button 81 need not be provided. It should be noted that, since it becomes unnecessary to use the individual start switch button 81 frequently, there is no problem even if the individual start switch button 81 is disposed on the second surface 22 other than the first surface 21.

In addition, once the main switch 31 is switched to the start position, the main switch 31 returns to the ON position when contact with the main switch 31 is released by the vessel operator, which makes it possible to re-do the collective engine start operation. Further, when the main switch 31 is switched to the start position, the output of the collective start command is continued for a predetermined period of time, such that the incomplete engine start is prevented.

Further, the collective start command is first transmitted only to the remote control ECU 60L and is then transmitted from the remote control ECU 60L to the remote control ECUs 60C and 60R, thus, the number of wirings is reduced.

Further, the start lamp 33 is turned on only when all the engines 61 are started in response to the output of the collective start command and, thus, enables to visually notify the user that all the engines 61 have started. The sound generator 62 generates sound when there is an engine 61 that does not start even when the start command is output and, thus, makes it possible to notify the user that there is the engine 61 that does not start.

The emergency switch 32 is provided separately from the main switch 31 and forcibly stops all the engines 61 in an emergency. The emergency switch 32 may be disposed at a position other than the main operator 30.

As described above, the main switch 31 is rotatable, so the first operation and the second operation are identified by the rotation position, however, it is not necessarily rotatable. For example, the main switch 31 may be pushed in at a plurality of stages such that the initial position is the OFF position, the first stage is the ON position, and the second stage is the start position. Moreover, the first operation and the second operation may have different forms of operation. For example, the first operation may be received by being switched by a rotating operation from the OFF position to the ON position, and the second operation may be received by being pushed in at the ON position.

In the description above, three remote control ECUs 60 are illustrated as start controllers that start all the engines 61 at once in response to receiving a collective start command. However, the start controller may be a single remote control ECU 60 common to the three outboard motor ECUs 20. That is, a single remote control ECU 60 may start all the engines 61 collectively.

In the preferred embodiments described above, the marine propulsion system includes three outboard motors 3, but there may be a different number of outboard motors 3, including four or more.

The preferred embodiments of the present invention are not limited to outboard motors, and are applicable to other types of marine propulsion devices such as inboard/outboard motors (stern drive, inboard motor/outboard drive), inboard motors, water jet drive, etc.

The present invention is not limited to the specific preferred embodiments described above, and various forms within the scope of the present invention are also included in the present invention.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion device controller comprising:

a main operator that outputs a start command to collectively start each engine of a plurality of propulsion devices; and a start controller configured or programmed to be activated in response to receiving a first operation on the main operator, and to start each engine of the plurality of propulsion devices in response to receiving the start command; wherein the main operator is provided in common for the plurality of propulsion devices, receives a second operation consecutively after receiving the first operation, and outputs the start command in response to receiving the second operation;

the second operation is received when the main operator is switched from a first position corresponding to the first operation to a second position; and the main operator returns to the first position when contact with the main operator by a vessel operator is released after receiving the second operation.

2. The marine propulsion device controller according to claim 1, wherein the main operator is disposed at a maneuvering console of a marine vessel on which the plurality of propulsion devices are mounted.

3. The marine propulsion device controller according to claim 2, wherein the main operator is disposed on a panel that includes at least one of a remote controller, a joystick, and a display.

4. A marine propulsion device controller comprising:

a main operator that outputs a start command to collectively start each engine of a plurality of propulsion devices;

a start controller configured or programmed to be activated in response to receiving a first operation on the main operator, and to start each engine of the plurality of propulsion devices in response to receiving the start command; and an individual start switch that individually starts each engine of the plurality of propulsion devices; wherein the main operator is provided in common for the plurality of propulsion devices, receives a second operation consecutively after receiving the first operation, and outputs the start command in response to receiving the second operation;

the main operator is disposed at a maneuvering console of a marine vessel on which the plurality of propulsion devices are mounted; and the individual start switch is located at a position of the maneuvering console other than a panel on which the main operator is disposed.

5. The marine propulsion device controller according to claim 1, wherein the main operator is rotatably operated between an initial position and the second position via the first position; and the first operation is received when the main operator is switched from the initial position to the first position.

6. The marine propulsion device controller according to claim 1, wherein the main operator continues to output the start command for a predetermined period of time in response to receiving the second operation.

7. A marine propulsion device controller comprising:

a main operator that outputs a start command to collectively start each engine of a plurality of propulsion devices; and a plurality of start controllers corresponding to the plurality of propulsion devices, the plurality of start controllers being configured or programmed to be activated in response to receiving a first operation on the main operator, and to start respective engines of the plurality of propulsion devices in response to receiving the start command; wherein the main operator is provided in common for the plurality of propulsion devices, receives a second operation consecutively after receiving the first operation, and outputs the start command in response to receiving the second operation;

the main operator outputs the start command to a representative start controller among the plurality of start controllers;

the representative start controller starts a corresponding engine in response to receiving the start command from the main operator, and transfers the start command to other start controllers among the plurality of start controllers; and each of the other start controllers starts the corresponding engine in response to receiving the transferred start command.

8. The marine propulsion device controller according to claim 1, further comprising a first notifier that notifies the vessel operator that all of the engines are started in response to outputting the start command.

9. The marine propulsion device controller according to claim 1, further comprising a second notifier that notifies the vessel operator that there is an engine that does not start even when the main operator outputs the start command.

10. The marine propulsion device controller according to claim 1, further comprising a switch provided separately from the main operator that forcibly stops all the engines.

11. A marine vessel propulsion system comprising:

a plurality of propulsion devices each including an engine; and the marine propulsion device controller according to claim 1 that controls the plurality of propulsion devices.

12. An engine starter for a marine propulsion device, the engine starter comprising:

a main operator that outputs a start command and is movable to a first position in response to receiving a first operation, and a second position in response to receiving a second operation; wherein the engine starter is provided in common for a plurality of propulsion devices, and receives the second operation continuous with and after receiving the first operation;

activates a start controller that starts an engine in each of the plurality of propulsion devices in response to receiving the first operation, and outputs the start command to the start controller in response to receiving the second operation to collectively start all the engines of the plurality of propulsion devices;

the second operation is received when the main operator is switched from the first position corresponding to the first operation to the second position; and the main operator returns to the first position when contact with the main operator by a vessel operator is released after receiving the second operation.

13. A marine vessel propulsion system comprising:

a plurality of propulsion devices each including an engine; and the marine propulsion device controller according to claim 4 that controls the plurality of propulsion devices.

14. A marine vessel propulsion system comprising:

a plurality of propulsion devices each including an engine; and the marine propulsion device controller according to claim 7 that controls the plurality of propulsion devices.

15. An engine starter for a marine propulsion device, the engine starter comprising:

a main operator that outputs a start command and is movable to a first position in response to receiving a first operation, and a second position in response to receiving a second operation; and an individual start switch that individually starts each engine of a plurality of propulsion devices; wherein the engine starter is provided in common for the plurality of propulsion devices, and receives the second operation continuous with after receiving the first operation, activates a start controller that starts an engine in each of the plurality of propulsion devices in response to receiving the first operation, and outputs the start command to the start controller in response to receiving the second operation to collectively start all the engines of the plurality of propulsion devices;

the main operator is disposed at a maneuvering console of a marine vessel on which the plurality of propulsion devices are mounted; and the individual start switch is located at a position of the maneuvering console other than a panel on which the main operator is disposed.

16. An engine starter for a marine propulsion device, the engine starter comprising:

a main operator that outputs a start command and is movable to a first position in response to receiving a first operation, and a second position in response to receiving a second operation; and a plurality of start controllers corresponding to a plurality of propulsion devices, the plurality of start controllers being configured or programmed to start respective engines of the plurality of propulsion devices in response to receiving the start command; wherein the engine starter is provided in common for the plurality of propulsion devices, receives the second operation consecutively after receiving the first operation, activates the plurality of start controllers that start the respective engines of the plurality of propulsion devices in response to receiving the first operation, and outputs the start command to a representative start controller among the plurality of start controllers in response to receiving the second operation to collectively start all the engines of the plurality of propulsion devices;

the representative start controller starts a corresponding engine in response to receiving the start command from the engine starter, and transfers the start command to other start controllers among the plurality of start controllers; and each of the other start controllers starts the corresponding engine in response to receiving the transferred start command.

* * * * *